US006438777B1

(12) United States Patent
Bender

(10) Patent No.: US 6,438,777 B1
(45) Date of Patent: Aug. 27, 2002

(54) SURGICAL SUPPORTING DEVICE

(75) Inventor: Bradley D. Bender, N. Smithfield, RI (US)

(73) Assignee: Tri-Medics, Inc., Providence, RI (US)

( * ) Notice: Subject to any disclaimer, the term of this patent is extended or adjusted under 35 U.S.C. 154(b) by 0 days.

(21) Appl. No.: 09/608,944

(22) Filed: Jun. 30, 2000

Related U.S. Application Data

(60) Provisional application No. 60/178,302, filed on Jan. 27, 2000.

(51) Int. Cl.[7] ..... A61G 7/075

(52) U.S. Cl. ..... 5/630; 5/632; 5/634; 5/648

(58) Field of Search ..... 5/630, 632, 633, 5/634, 646, 648, 651, 506.1, 612, 621, 624

(56) References Cited

U.S. PATENT DOCUMENTS

| | | | | |
|---|---|---|---|---|
| 471,895 A | | 3/1892 | Reeves | |
| 591,099 A | * | 10/1897 | Harbaugh | 5/634 |
| 830,776 A | | 9/1906 | Flagg | |
| 1,452,915 A | | 4/1923 | Kennedy | |
| 1,619,685 A | * | 3/1927 | Updegrove et al. | 5/648 |
| 1,650,261 A | | 11/1927 | Carlson | |
| 2,346,722 A | | 4/1944 | Bowman | |
| 2,390,660 A | | 12/1945 | Muenzen | |
| 2,461,434 A | | 2/1949 | Moyers | |
| 2,581,110 A | | 1/1952 | Kenworthy | |
| 2,663,880 A | | 12/1953 | Meeks | |
| 3,007,739 A | | 11/1961 | Delia | |
| 3,065,992 A | | 11/1962 | Nagel | |
| 3,066,322 A | | 12/1962 | Derby | |
| 3,121,884 A | * | 2/1964 | Emery | 5/634 |
| 3,173,157 A | * | 3/1965 | Maples | 5/651 |
| 3,753,557 A | | 8/1973 | Kelley | |
| 4,471,768 A | | 9/1984 | Ciullo | |
| 4,550,901 A | | 11/1985 | Muchisky et al. | |
| 4,688,793 A | | 8/1987 | Syrek, III | |
| 5,437,069 A | * | 8/1995 | Bates | 5/633 |
| 5,438,720 A | | 8/1995 | Daneshvar | |
| 5,462,551 A | | 10/1995 | Bailey et al. | |
| 5,887,589 A | | 3/1999 | Hogan | |

FOREIGN PATENT DOCUMENTS

| | | |
|---|---|---|
| CH | 355270 | 8/1961 |
| GB | 1 346 075 | 2/1974 |

OTHER PUBLICATIONS

Universal Knee Positioners, Accurate Position & Control, IMP.

Universal Lateral Positioner, Assures Patient Stability, IMP.

Knee Positioning Triangle, Easy, Reliable Positioning of the Knee and Lower Leg, IMP.

* cited by examiner

*Primary Examiner*—Michael F. Trettel
(74) *Attorney, Agent, or Firm*—Kenyon & Kenyon

(57) ABSTRACT

A supporting device includes a plurality of frame elements. Each end of the frame elements is hingedly connected to one end of an adjacent frame element to define a closed structure. The length of each frame element is adjustable, and the angle formed between adjacent frame elements is adjustable.

39 Claims, 6 Drawing Sheets

SURGICAL SUPPORTING DEVICE

CROSS REFERENCE TO RELATED APPLICATIONS

This application claims the benefit of U.S. Provisional Application No. 60/178,302, filed on Jan. 27, 2000.

FIELD OF THE INVENTION

The present invention relates generally to a supporting device used to support at least a portion of a body during a surgical or other medical or therapeutic procedure.

BACKGROUND INFORMATION

The literature is replete with descriptions of body-supporting devices. For example, U.S. Pat. No. 471,895 to Reeves describes a head rest for beds. The head rest includes two independent adjustments used to adjust an inclination of a supporting fabric.

U.S. Pat. No. 830,776 to Flagg describes a leg rest for resting the leg of a patient. The rest is supported on two arms, which are adjustable to thereby adjust the inclination of the rest.

U.S. Pat. No. 1,452,915 to Kennedy describes a support device for invalids. The support device includes a base, a first plate pivotally connected to the forward end of the base and a second plate pivotally connected to the first plate. The free edge of the second plate is cooperable with a series of inclined notches formed in bars extending from the base to thereby adjust the height and inclination of the first and second plates.

U.S. Pat. No. 1,650,261 to Carlson describes a buttocks elevator, which includes a lower member and an upper member. The lower member and upper member are hinged together by a hinge shaft. An arm is hinged on the lower member, and a wrench extends perpendicularly from the arm. Pivoting the wrench causes the arm to pivot to thereby raise the upper member, pivoting the upper member about the hinge shaft.

U.S. Pat. No. 2,346,722 to Bowman describes a leg rest, which includes a base, a platform hingedly secured at one end to the base and a pair of props hingedly secured along the length of the base. The free ends of the props are selectively engageable with one of two bars disposed along the length of the platform to thereby adjust the elevation and inclination of the platform.

U.S. Pat. No. 2,390,660 to Muenzen describes a folding reclining bed board, which includes a main body and a flat back-rest hinged at one end thereof to the main body. An outer prop and an inner prop are provided for selectively adjusting the inclination of the backrest between a first inclined position and a second inclined position.

U.S. Pat. No. 2,461,434 to Mogers describes a folding mechanical pillow, which includes a base and a frame hingedly secured to the base. A telescoping mechanism is provided at the free end of the frame to adjust the inclination of the frame.

U.S. Pat. No. 2,581,110 to Kenworthy describes an adjustable leg rest for invalids. The leg rest includes a leg support supported on a base by telescoping bars. The telescoping bars are adjustable to adjust the elevation and inclination of the leg support.

U.S. Pat. No. 2,663,880 to Meeks describes a collapsible back rest, which includes telescoping legs for adjusting an inclination of a stretch band.

U.S. Pat. No. 3,007,739 to Delia describes a leg rest, which is selectively adjustable between a first, straight position and a second, flat position.

U.S. Pat. No. 3,065,992 to Nagel describes an adjustable leg rest, which includes a bottom piece, a top piece and two end pieces hingedly secured to each end of the top and bottom pieces. The top piece, bottom piece and end pieces define a quadrilateral structure.

U.S. Pat. No. 3,066,322 to Derby describes a leg and foot support, which includes a base section, an upper leg supporting frame section pivotably connected to the base section and a pair of braces pivotably connected to the upper leg supporting frame section and slidably connected to the base section. The inclination of the upper leg supporting section is adjustable by adjusting the braces.

U.S. Pat. No. 3,753,557 to Kelley describes a device for supporting a person's leg during knee surgery. The device includes a base, an upright hingedly connected to one end of the base and a leg support hingedly connected to an opposite end of the upright. A prop is provided so that the device may be arranged in a first configuration, wherein the base, upright and leg support define a triangular structure, and a second configuration, wherein the base, upright, leg support and prop define a quadrilateral structure. The position of the hinge connecting the upright to the base is adjustable, and the length of the upright is adjustable.

U.S. Pat. No. 4,471,768 to Ciullo describes a fracture positioning device having a pair of arms with ends pivotally attached to provide the positive force necessary to position bone fracture fragments during surgery.

U.S. Pat. No. 4,550,901 to Machisky et al. describes a portable adjustable body tilt board, which includes a pair of panel members connected along a hinge section. A nylon strap is affixed at one end to an edge of one of the panel members and having a hook-and-loop fastening material at its free end for fastening the free end to a matching hook-and-loop fastening material provided on the panel member. The angle between the panel members may be selectively adjusted by adjusting the fastening position of the strap with respect to the panel member.

U.S. Pat. No. 4,688,793 to Syrek describes a weight-lifting apparatus, which includes a chest platform and a thigh support attached to the chest platform by a hinge mechanism. A locking telescoping device is provided for selectively adjusting the angle between the chest platform and the thigh support.

U.S. Pat. No. 5,438,720 to Daneshvar describes a toe protector, which includes a base part hingedly connected to a first side piece. The first side piece is hingedly connected to a second side piece. The base includes notches for accepting the free end of the second side piece to selectively adjust a height of the toe protector.

U.S. Pat. No. 5,462,551 to Bailey et al. describes a knee positioner for adjustably positioning the knee joint during a surgical operating procedure. The apparatus includes a rigid frame releasably attachable to an operating table. The rigid frame is provided with one or more rods to movably support a carriage that can be releasably locked in position and which adjustably supports a boot that can be releasably locked in position on the carriage. A commercial embodiment of the device described in Bailey et al. U.S. Pat. No. 5,462,551 is sold by Innovative Medical Products, Inc. (Plainville, Conn.) under the trade name IMP UNIVERSAL KNEE POSITIONER™, or simply, UNIVERSAL KNEE POSITIONER™.

U.S. Pat. No. 5,887,589 to Hogan describes a skeletal realignment system, which includes a vertical section connected to an inclined upper section.

In addition to the foregoing, there are a myriad of commercially available positioners. One such device is composed of three rigid panels attached at their respective ends to define a right triangle. In such a device, the relative angles between the adjacent panels are fixed. Accordingly, the only adjustment available in such a device is the orientation of the device with respect to the patient.

The above described prior art supporting devices suffer from several significant disadvantages. For example, the range of adjustments available in such supporting devices is limited. While the limited adjustability may not present any problem in certain circumstances, the surgical and medical fields are in need of a supporting device that can be easily and effectively adjusted over a wide range of positions and configurations. As a particular example, a surgeon performing a surgical procedure on a human knee joint may be required to position the knee in a fully extended position and in a fully bent position during the course of the procedure to ensure the proper range of motion in the knee joint. Heretofore, surgeons have employed operating room personnel to manually support and manipulate the patient's leg and knee joint to achieve the necessary positioning and manipulation. This type of manual positioning and manipulation is not only inaccurate but also increases the number of operating room personnel, increases fatigue of such personnel and detracts such personnel from performing other, more critical, functions. It is therefore an object of the present invention to provide a fully adjustable surgical supporting device.

SUMMARY

The above and other beneficial objects of the present invention are most effectively attained by providing an adjustable surgical supporting device as disclosed and claimed herein. In one embodiment, the surgical supporting device includes a plurality of frame elements, each being hingedly attached at each end to one of the ends of an adjacent frame element to define a closed structure. A length of each frame member is adjustable between a maximum and minimum length. The angle between each pair of adjacent frame elements is also adjustable.

DETAILED DESCRIPTION

Figure 1:
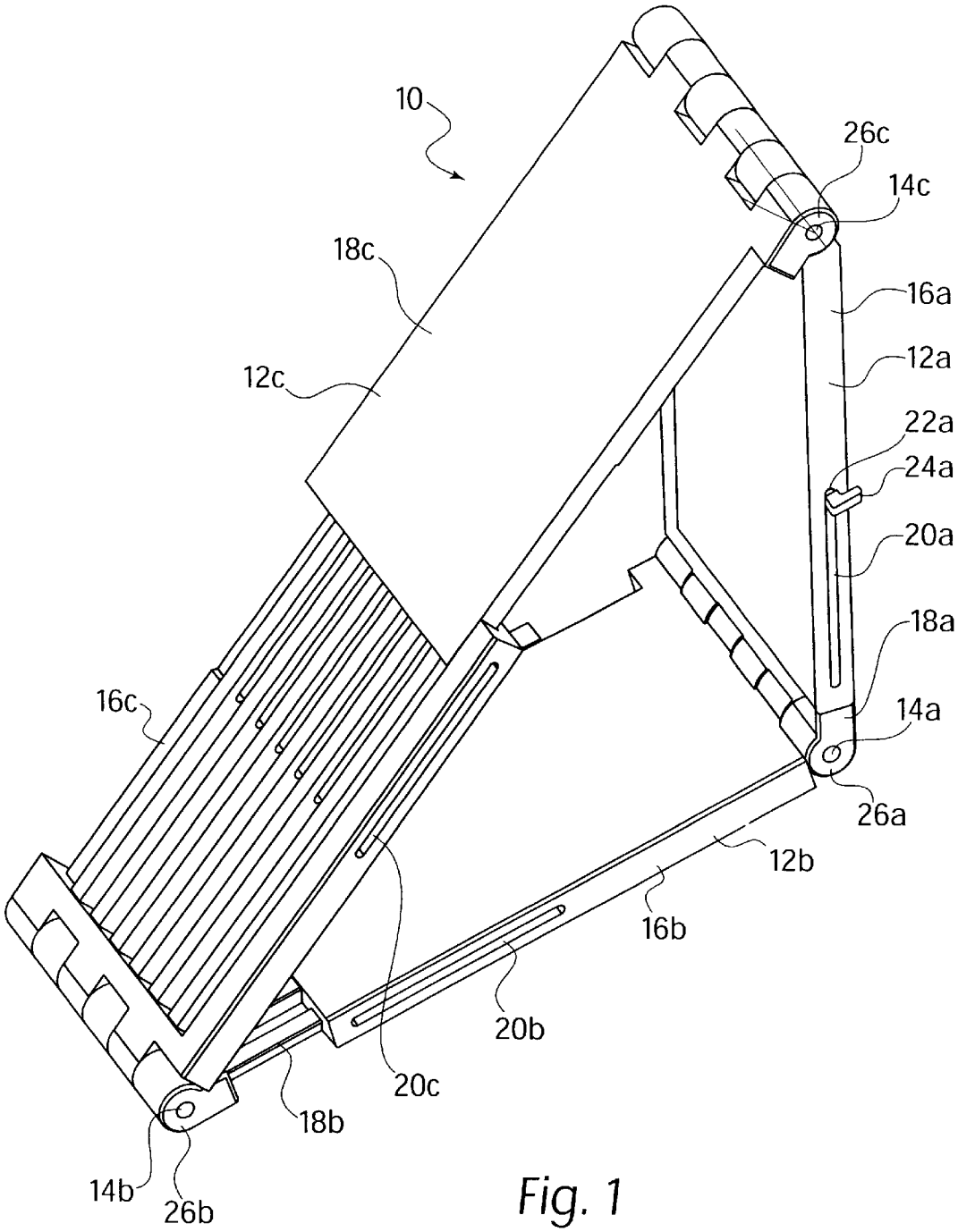
FIG. 1 is a front perspective view of a surgical supporting device according to the present invention.

Those skilled in the art will gain an appreciation of the present invention when viewed in conjunction with the accompanying drawings of FIGS. 1–9, inclusive. The individual reference characters designate the same or similar elements throughout the several views.

Referring to FIG. 1, there is seen a front perspective view of a surgical supporting device 10 according to the present invention. Surgical supporting device 10 consists of three frame elements 12*a*, 12*b*, 12*c*. Each frame element 12*a*, 12*b*, 12*c* is hingedly connected to the respective adjacent frame elements via hinge pins 14*a*, 14*b*, 14*c*. That is, frame elements 12*a* and 12*b* are hingedly connected via hinge pin 14*a*; frame elements 12*b* and 12*c* are hingedly connected via hinge pin 14*b*; and frame elements 12*c* and 12*a* are hingedly connected via hinge pin 14*c*. Each frame element 12*a*, 12*b*, 12*c* is formed of a respective pair of segments 16*a*, 18*a*, 16*b*, 18*b*, 16*c*, 18*c*, which are adapted to be relatively slidable to thereby make the length of the frame elements 12*a*, 12*b*, 12*c* adjustable. Preferably, each segment 16*a*, 16*b*, 16*c*, 18*a*, 18*b*, 18*c* is formed of a radiolucent material that is at least partially permeable to radiation. More preferably, the radiolucent material is substantially wholly permeable to radiation. The segments 16*a*, 16*b*, 16*c*, 18*a*, 18*b*, 18*c* may be formed by such techniques as extrusion, machining, injection molding, thermoforming and the like. For cost savings and ease of manufacture, at least each of the segments 16*a*, 16*b*, 16*c* are identical, and at least each of the segments 18*a*, 18*b*, 18*c* are identical. For further cost savings and ease of manufacture, respective pairs of segments 16*a* and 18*a*, 16*b* and 18*b*, 16*c* and 18*c* may be formed as a single piece ("integral") and then separated and engaged to thereby define the respective frame element 12*a*, 12*b*, 12*c*.

Figure 2:
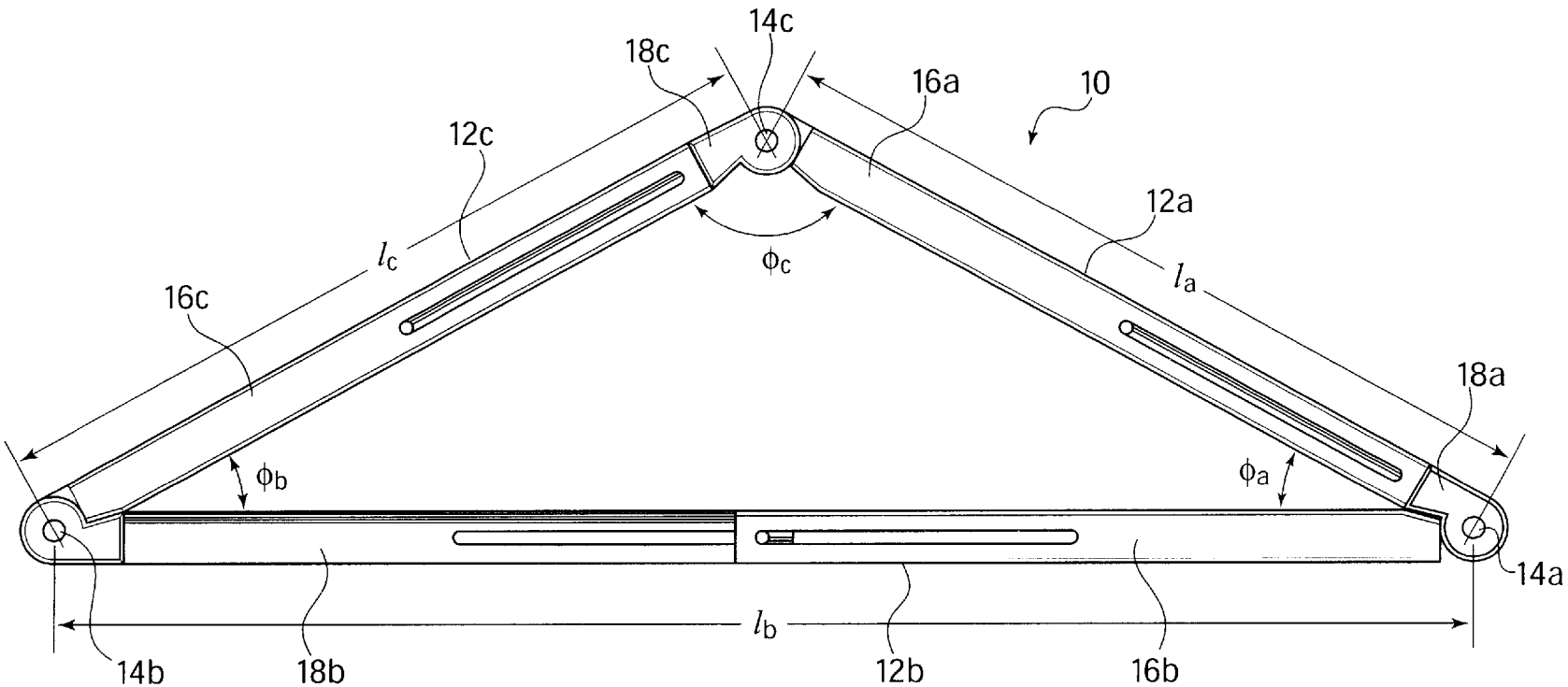
FIG. 2 is a front elevational view of the surgical supporting device illustrated in FIG. 1 in a first position.

Referring now to FIG. 2, there is seen a front elevational view of the surgical supporting device 10 illustrated in FIG. 1. FIG. 2 illustrates the surgical supporting device 10 in a first configuration or position, wherein the length of frame element 12*a* has been set to $\mathbf{1}_a$, the length of frame element 12*b* has been set to $\mathbf{1}_b$ and the length of frame element 12*c* has been set to $\mathbf{1}_c$. As further illustrated in FIG. 2, the angle formed between frame elements 12*a*, 12*b* has been set to $\phi_a$, the angle formed between frame elements 12*b*, 12*c* has been set to $\phi_b$ and the angle formed between frame elements 12*c*, 12*a* has been set to $\phi_c$.

Figure 3:
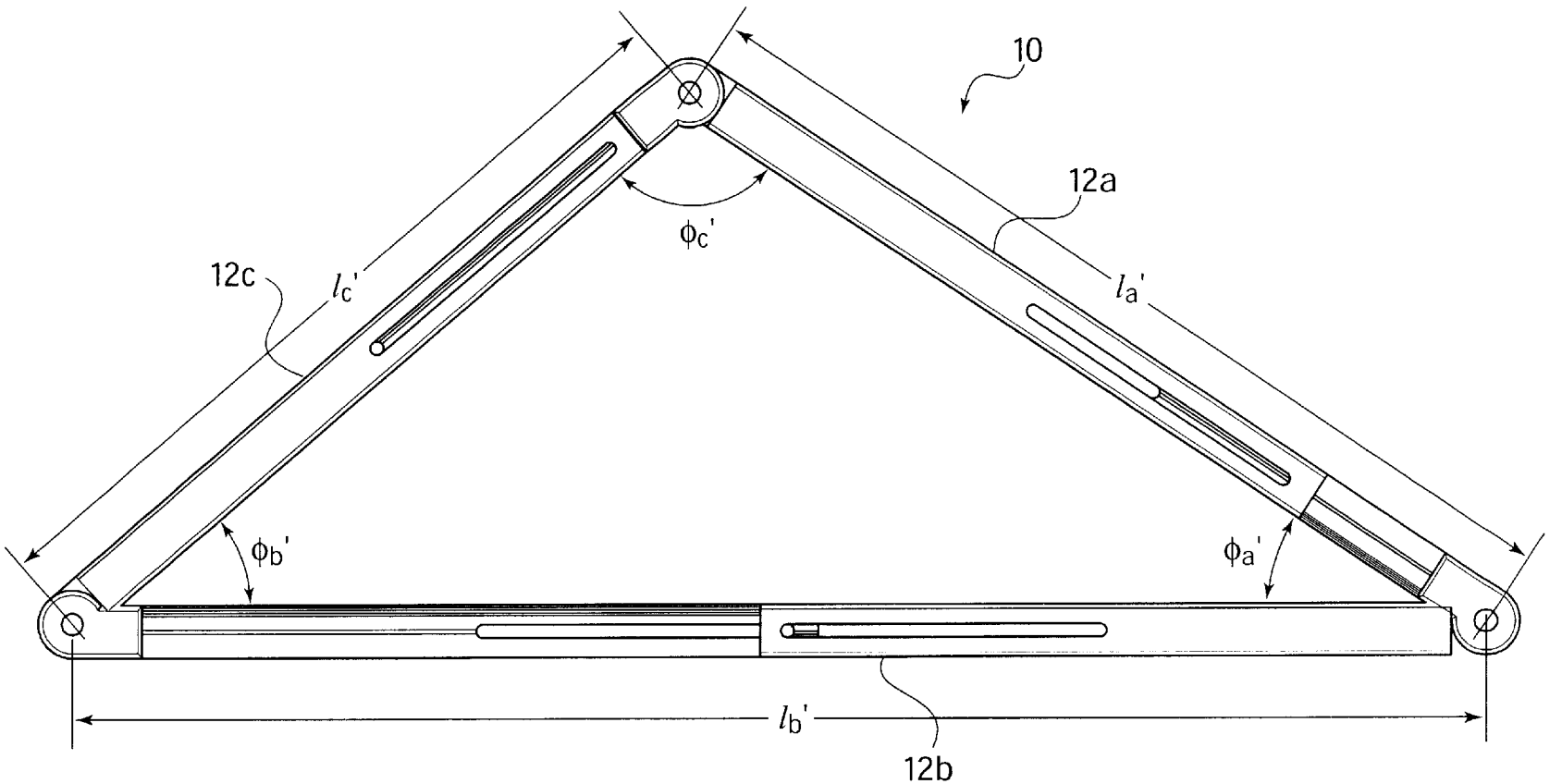
FIG. 3 is a front elevational view of the surgical supporting device illustrated in FIGS. 1 and 2 in a second position.

Referring now to FIG. 3, there is seen a front elevational view of the surgical supporting device 10 illustrated in FIGS. 1 and 2. However, in FIG. 3, the surgical supporting device 10 has been adjusted into a second configuration or position, wherein the length of frame element 12*a* has been set to $\mathbf{1}_a'$, the length of frame element 12*b* has been set to $\mathbf{1}_b'$ and the length of frame element 12*c* has been set to $\mathbf{1}_c'$. In the second configuration of surgical supporting device 10 as illustrated in FIG. 3, the angle formed between frame elements 12*a*, 12*b* has been set to $\phi_a'$, the angle formed between frame elements 12*b*, 12*c* has been set to $\phi_b'$ and the angle formed between frame elements 12*c*, 12*a*, has been set to $\phi_c'$. It will be apparent to those skilled in the art that the length of each frame element 12*a*, 12*b*, 12*c* is variable and adjustable between respective minimum and maximum lengths and that the angles formed between adjacent frame elements is variable and adjustable between respective minimum and maximum values. It will also be apparent to those skilled in the art that the configurations illustrated in FIGS. 2 and 3 are intended only to be exemplary. Preferably, the frame elements should be adapted to that the minimum and maximum lengths and angles allows the surgical supporting device 10 to be arranged in a first extreme position and a second extreme position. In the first extreme position, the minimum value of angle $\phi_a$ may be selected to be an acute angle of, for example, 20°, and in the second extreme position, the maximum value of angle $\phi_a$ may be selected to be substantially 180°. Thus, the surgical supporting device 10 according to the present invention, when used in a surgical procedure on, for example, the human knee, permits the joint to be effectively supported in the fully extended and fully bent positions.

The surgical supporting device 10 may include a locking mechanism to temporarily fix the selected lengths of the frame elements 12*a,* 12*b,* 12*c.* For example, each frame element 12*a,* 12*b,* 12*c* includes a respective slot 20*a,* 20*b,* 20*c.* A rod 22*a* may be received in the slot 20*a,* and a camming lever 24*a* may be provided at a protruding end of the rod 22*a.* In a first position, the camming lever 24*a* may allow the segment 16*a* to be slidable with respect to the respective segment 18*a.* In a second position, which may be, for example, one-quarter turn from the first position, the camming lever 24*a* may exert a compressive force across the width of the frame element 12*a,* thereby frictionally maintaining the relative positions of the segment 16*a* and the respective segment 18*a.* Although the rod 22*a* and camming lever 24*a* are illustrated and described herein with respect to only one frame element 12*a,* it should be understood that the frame elements 12*b,* 12*c* may also include a corresponding rod and camming lever. Alternatively, a threaded rod and threaded knob or wing nut may be provided in one or more of the slots 20*a,* 20*b,* 20*c* to frictionally maintain the selectively adjusted length of the frame elements 12*a,* 12*b,* 12*c.* In addition, one or more of the hinge pins 14*a,* 14*b,* 14*c* may be provided with such a locking mechanism. It will be appreciated to those skilled in the art that many alternative frictional locking mechanisms may be provided. Such frictional locking mechanisms are advantageous in that the length of the frame elements 12*a,* 12*b,* 12*c* and the angles therebetween may be infinitely adjustable between the minimum length and the maximum length.

As an alternative or in addition to the aforementioned frictional locking mechanisms, one or more of the frame elements 12*a,* 12*b,* 12*c* may be provided with a locking mechanism, which releasably fixes the length of the frame element 12*a,* 12*b,* 12*c* at one of a finite number of discrete lengths. An example of such a locking mechanism is a ratchet mechanism. A ratchet mechanism is advantageous over the aforementioned frictional locking mechanisms in that the ratchet mechanism may be self-energizing. Another example of a locking mechanism is a series of splines on the hubs 26*a,* 26*b,* 26*c* of the frame elements 12*a,* 12*b,* 12*c.*

Figure 4:
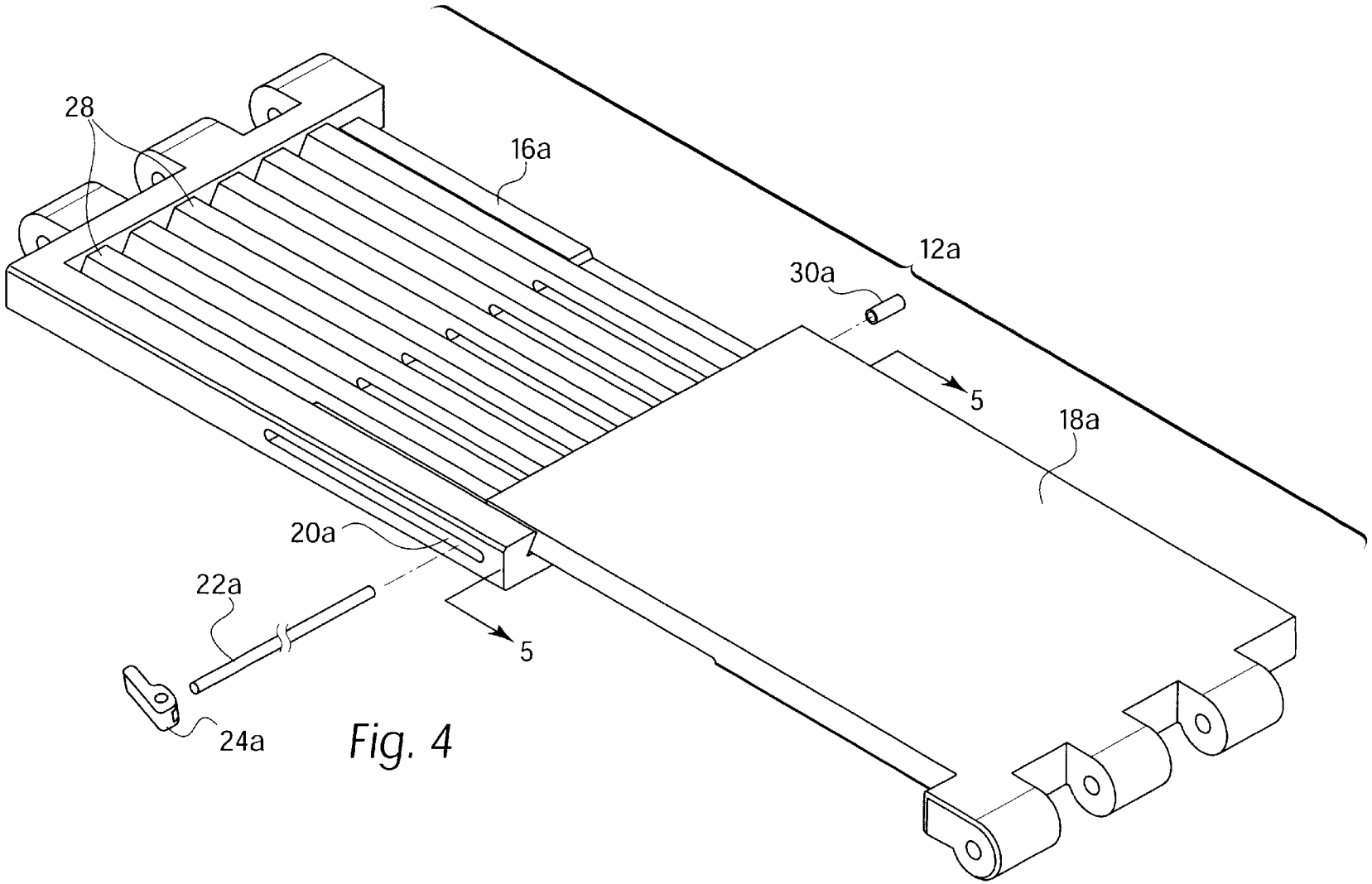
FIG. 4 is a front perspective view of one frame element of the surgical supporting device illustrated in FIGS. 1–3.

Referring now to FIG. 4, there is seen a front perspective view of frame member 12*a.* It should be appreciated that the following description of frame member 12*a* is applicable to frame members 12*b,* 12*c.* As seen in FIG. 4, segment 16*a* includes a plurality of longitudinal spines 28. Slot 20*a* is formed through all of spines 28 so that rod 22*a* of locking mechanism may traverse the width of frame member 12*a.* The end of rod 22*a* opposite to the camming lever 24*a* may be secured with, for example, nut 30*a* or another securing member, which is known to those skilled in the art. Alternatively, the end of rod 22*a* opposite to the camming lever 24*a* may be provided with an enlarged head or may be secured into a portion of one of the segments 16*a,* 18*a.* The underside of segment 18*a,* as viewed from the perspective of FIG. 4, is provided with mating spines, not shown, that are complementary to spines 28 of segment 16*a.* Thus, segment 18*a* is slidable with respect to segment 16*a* and selectively lockable at any desired length between the minimum length and the maximum length.

Figure 5:
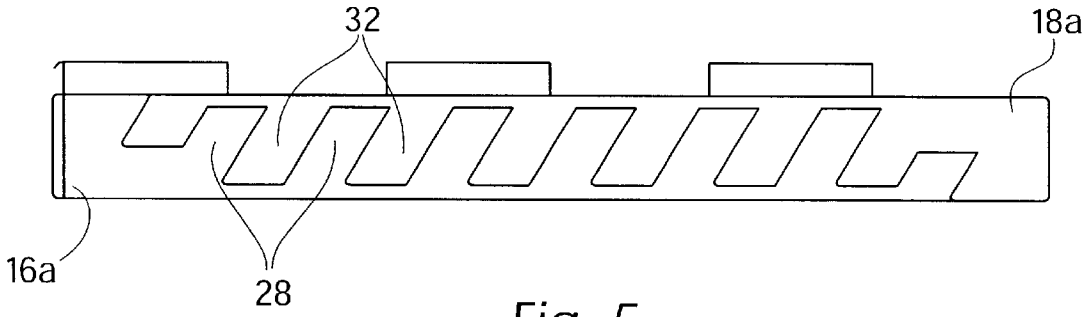
FIG. 5 is a cross-sectional view of the frame element illustrated in FIG. 4 taken along the line 5—5.

Referring now to FIG. 5, there is seen a cross-sectioned view of frame member 12, illustrated in FIG. 4, taken along the line 5—5. FIG. 5 illustrates the engagement of spines 28 of segment 16*a* with spines 32 of segment 18*a.*

Referring again to FIG. 4, it will be appreciated that the segments 16*a,* 18*a* may be self-complementary. That is, segment 16*a* may be identical to segment 18*a* and that the identical segments 16*a,* 18*a* may be engaged to define frame member 12*a.* Thus, six identical segments are necessary to construct the surgical supporting device 10 shown in FIGS. 1–3. Thus, a considerable cost savings and ease of manufacture is achieved.

Referring again to FIG. 1, the width of the frame member 12*a,* 12*b,* 12*c* should be adapted so that the intended body part or parts may be effectively supported.

Figure 6:
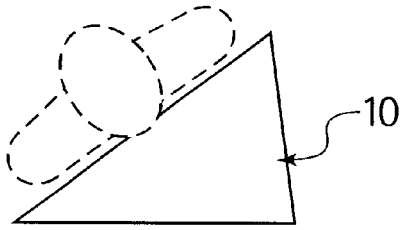
FIG. 6 is a schematic front elevational view of the surgical supporting device illustrated in FIG. 1, supporting a human torso, which is shown in phantom.
Figure 7A:
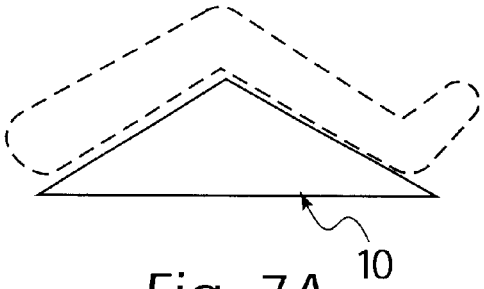
FIGS. 7*a*–7*c* are schematic front elevational views of the surgical supporting device illustrated in FIG. 1, supporting a human leg, which is shown in phantom, in three different positions.
Figure 7B:
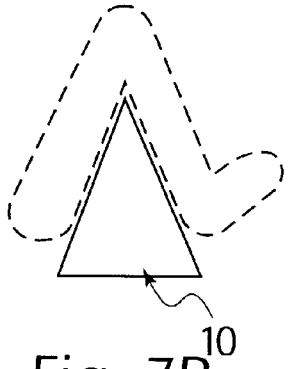
Figure 7C:
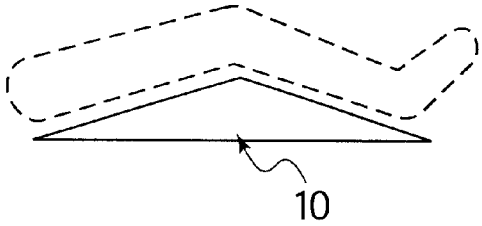
Figure 8:
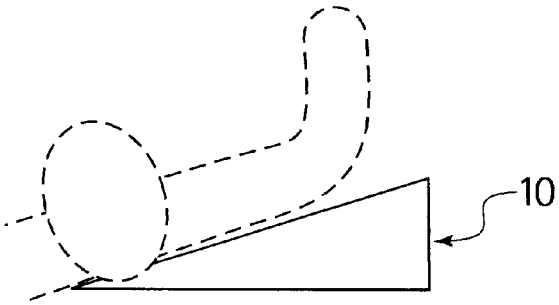
FIG. 8 is a schematic front elevational view of the surgical supporting device illustrated in FIG. 1, supporting a human shoulder and arm, which are shown in phantom.

FIGS. 6–8 illustrate the surgical supporting device 10 supporting a variety of human body sections. More particularly, FIG. 6 illustrates, schematically, the surgical supporting device 10 supporting a human torso, which is shown in phantom. FIGS. 7*a,* 7*b* and 7*c* illustrate, schematically, the surgical supporting device 10 supporting a human leg and foot in three different positions. In FIGS., 7*a,* 7*b* and 7*c,* the human leg and foot are shown in phantom. Finally, FIG. 8 illustrates, schematically, the surgical supporting device 10 supporting the human shoulder and forearm, both shown in phantom. It will be appreciated that FIGS. 6–8 are intended to illustrate certain applications of surgical supporting device 10 and are in no way limiting.

Figure 9:
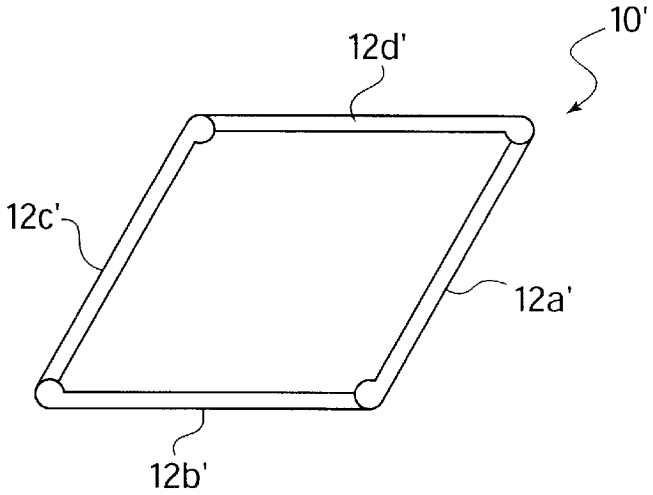
FIG. 9 is a schematic front elevational view of a second embodiment of the surgical supporting device of the present invention.

Finally, referring to FIG. 9, there is seen a schematic, front elevational view of a second embodiment of the surgical supporting device 10', which includes four frame elements 12*a*', 12*b*', 12*c*', 12*d*' hingedly connected at their ends. A cross-brace, not shown, may be provided and attached to two of the frame elements 12*a*', 12*b*', 12*c*', 12*d*' for stability. It will be appreciated that any number of frame elements may be provided and that the embodiments described herein are only meant as exemplary embodiments, which are in no way limiting.

Thus, the aforementioned objects and advantages of the present invention are most effectively attained. Those skilled in the art will appreciate that numerous modifications of the preferred embodiments described herein may be made without departing from the spirit and scope of the invention. For example, the material from which the surgical supporting device 10 is made may be selected so that the entire device is autoclavable. In addition, the adjustment of the lengths of one or more frame members 12*a,* 12*b,* 12*c* may be mechanized by, for example, providing a lead screw along the length thereof rotatable under the control of a servo or other motor and a corresponding control device. A pneumatic or hydraulic piston or a linear motor or actuator may also be used to mechanize the adjustments. A vernier or other metering device may be provided to indicate, measure and make repeatable the adjustment, and such metering device may be applied to indicate the length of any one or more frame elements or the angle formed between frame elements. A pad may be provided on one or more of the frame elements 12*a,* 12*b,* 12*c.* Finally, the surgical supporting device 10 may be adapted to be attachable to an operating table, hospital bed or other supporting member or may be free-standing. Although the preferred embodiments of the present invention have been described and disclosed in detail herein, it should be understood that this invention is in no sense limited thereby and that its scope is to be determined by that of the appended claims.

What is claimed is:

1. A supporting device, comprising:

a plurality of frame elements, each of the frame elements having a first end and a second end opposing the first end, the first end of each frame element being hingedly connected to the second end of an adjacent frame element to define a closed structure;

wherein a length of each frame element between the first end and the second end is selectively adjustable.

2. The supporting device according to claim 1, wherein an angle formed between each pair of adjacent frame elements is selectively adjustable.

3. The supporting device according to claim 2, further comprising at least one locking mechanism releasably securing one of the selectively adjusted length of the frame element and the selectively adjusted angle between adjacent frame elements.

4. The supporting device according to claim 3, wherein the locking mechanism frictionally releasably secures the one of the selectively adjusted length and the selectively adjusted angle.

5. The supporting device according to claim 3, wherein the locking mechanism releasably secures the one of the selectively adjusted length and the selectively adjusted angle in one of a plurality of discrete values.

6. The supporting device according to claim 1, wherein the frame members are formed of a radiolucent material.

7. The supporting device according to claim 1, further comprising a pad mounted on at least one of the frame elements.

8. The supporting device according to claim 1, further comprising a brace, the brace having a first end connected to one of the frame elements and a second end connected to another one of the frame elements.

9. The supporting device according to claim 1, wherein the length of each frame element is selectively adjustable while maintaining the hinged connection between the frame elements.

10. The supporting device according to claim 1, wherein each frame element is rigid.

11. A supporting device, comprising:

a plurality of frame elements, each of the frame elements having a first end and a second end opposing the first end, the first end of each frame element being hingedly connected to the second end of an adjacent frame element to define a closed structure, a length of each frame element between the first end and the second end being selectively adjustable and an angle formed between each pair of adjacent frame elements being selectively adjustable; and at least one locking mechanism releasably securing one of the selectively adjusted length of the frame element and the selectively adjusted angle between adjacent frame elements;

wherein the locking mechanism includes a camming mechanism.

12. A supporting device, comprising:

a plurality of frame elements, each of the frame elements having a first end and a second end opposing the first end, the first end of each frame element being hingedly connected to the second end of an adjacent frame element to define a closed structure, a length of each frame element between the first end and the second end being selectively adjustable and an angle formed between each pair of adjacent frame elements being selectively adjustable; and at least one locking mechanism releasably securing one of the selectively adjusted length of the frame element and the selectively adjusted angle between adjacent frame elements;

wherein the locking mechanism includes a ratchet mechanism.

13. A supporting device, comprising:

a plurality of frame elements, each of the frame elements having a first end and a second end opposing the first end, the first end of each frame element being hingedly connected to the second end of an adjacent frame element to define a closed structure;

wherein a length of each frame element between the first end and the second end is selectively adjustable; and wherein each frame member comprises a first segment and a second segment in engagement with the first segment, the first and second segments being relatively slidable.

14. The supporting device according to claim 13, wherein the first and second segments are self-complementary.

15. The supporting device according to claim 13, wherein the first and second segments are integrally formed and separable and engageable after having been integrally formed.

16. The supporting device according to claim 13, further comprising at least one locking mechanism releasably securing the first and second segments to prevent the relative sliding thereof.

17. The supporting device according to claim 16, wherein the locking mechanism frictionally secures the first and second segments.

18. The supporting device according to claim 16, wherein the locking mechanism includes a camming mechanism.

19. The supporting device according to claim 16, wherein the locking mechanism includes a ratchet mechanism.

20. A supporting device, comprising:

a plurality of frame elements, each of the frame elements having a first end and a second end opposing the first end, the first end of each frame element being hingedly connected to the second end of an adjacent frame element to define a closed structure, a length of each frame element between the first end and the second end being selectively adjustable; and at least one adjusting mechanism controlling the selective adjustment of the length of a respective one of the frame elements.

21. The supporting device according to claim 20, further comprising an electric motor driving the adjusting mechanism.

22. The supporting device according to claim 20, further comprising a hydraulic mechanism driving the adjusting mechanism.

23. The supporting device according to claim 20, further comprising a pneumatic mechanism driving the adjusting mechanism.

24. A supporting device, comprising:

a plurality of frame elements, each of the frame elements having a first end and a second end opposing the first end, the first end of each frame element being hingedly connected to the second end of an adjacent frame element to define a closed structure, a length of each frame element between the first end and the second end being selectively adjustable and an angle formed between each pair of adjacent frame elements being selectively adjustable; and at least one adjusting mechanism controlling the selective adjustment of the angle between adjacent frame elements.

25. The supporting device according to claim 24, further comprising an electric motor driving the adjusting mechanism.

26. The supporting device according to claim 24, further comprising a hydraulic mechanism driving the adjusting mechanism.

27. The supporting device according to claim 24, further comprising a pneumatic mechanism driving the adjusting mechanism.

28. A supporting device, comprising:

a plurality of frame elements, each of the frame elements having a first end and a second end opposing the first end, the first end of each frame element being hingedly connected to the second end of an adjacent frame element to define a closed structure;

wherein a length of each frame element between the first end and the second end is selectively adjustable; and wherein the supporting device is autoclavable.

29. A supporting device, comprising:

a plurality of frame elements, each of the frame elements having a first end and a second end opposing the first end, the first end of each frame element being hingedly connected to the second end of an adjacent frame element to define a closed structure;

wherein an angle formed between each pair of adjacent frame elements is selectively adjustable; and wherein each frame member comprises a first segment and a second segment in engagement with the first segment, the first and second segments being relatively slidable.

30. The supporting device according to claim 29, wherein the first and second segments are self-complementary.

31. The supporting device according to claim 29, wherein the first and second segments are integrally formed and separable and engageable after having been integrally formed.

32. The supporting device according to claim 29, further comprising at least one locking mechanism releasably securing the first and second segments to prevent the relative sliding thereof.

33. The supporting device according to claim 32, wherein the locking mechanism frictionally secures the first and second segments.

34. The supporting device according to claim 32, wherein the locking mechanism includes a camming mechanism.

35. The supporting device according to claim 32, wherein the locking mechanism includes a ratchet mechanism.

36. A supporting device, comprising:

a plurality of frame elements, each of the frame elements having a first end and a second end opposing the first end, the first end of each frame element being hingedly connected to the second end of an adjacent frame element to define a closed structure, an angle formed between each pair of adjacent frame elements being selectively adjustable;

at least one adjusting mechanism controlling the selective adjustment of the angle formed between a respective pair of adjacent frame elements; and an electric motor driving the adjusting mechanism.

37. A supporting device, comprising:

a plurality of frame elements, each of the frame elements having a first end and a second end opposing the first end, the first end of each frame element being hingedly connected to the second end of an adjacent frame element to define a closed structure, an angle formed between each pair of adjacent frame elements being selectively adjustable;

at least one adjusting mechanism controlling the selective adjustment of the angle formed between a respective pair of adjacent frame elements; and a hydraulic mechanism driving the adjusting mechanism.

38. A supporting device, comprising:

a plurality of frame elements, each of the frame elements having a first end and a second end opposing the first end, the first end of each frame element being hingedly connected to the second end of an adjacent frame element to define a closed structure, an angle formed between each pair of adjacent frame elements being selectively adjustable;

at least one adjusting mechanism controlling the selective adjustment of the angle formed between a respective pair of adjacent frame elements; and a pneumatic mechanism driving the adjusting mechanism.

39. A supporting device, comprising:

a plurality of frame elements, each of the frame elements having a first end and a second end opposing the first end, the first end of each frame element being hingedly connected to the second end of an adjacent frame element to define a closed structure;

wherein an angle formed between each pair of adjacent frame elements is selectively adjustable; and wherein the supporting device is autoclavable.

* * * * *